United States Patent [19]

Cullinan et al.

[11] Patent Number: 5,037,725

[45] Date of Patent: Aug. 6, 1991

[54] PROCESS FOR STABILIZING PHOTOGRAPHIC ELEMENTS

[75] Inventors: Ann M. Cullinan, Hilton; Charles M. Darmon, Spencerport; William G. Henry, Caledonia; Paul A. Schwartz, Webster, all of N.Y.

[73] Assignee: Eastman Kodak Company, Rochester, N.Y.

[21] Appl. No.: 448,402

[22] Filed: Dec. 11, 1989

[51] Int. Cl.[5] ..... G03C 7/40

[52] U.S. Cl. ..... 430/372; 430/427; 430/428; 430/429

[58] Field of Search ..... 430/372, 427, 428, 429

[56] References Cited

U.S. PATENT DOCUMENTS

| | | | |
|---|---|---|---|
| 2,647,057 | 7/1953 | Seary et al. | 95/88 |
| 2,885,288 | 5/1959 | Beswick et al. | 430/427 |
| 3,676,136 | 7/1972 | Mowrey | 430/372 |
| 3,879,202 | 4/1975 | Yamaguchi | 96/22 |
| 4,170,479 | 10/1979 | Usami | 430/509 |
| 4,837,139 | 6/1989 | Kobayashi et al. | 430/491 |
| 4,921,779 | 5/1990 | Culliman et al. | 430/427 |
| 4,960,682 | 10/1990 | Cullinan et al. | 430/393 |
| 4,975,356 | 12/1990 | Cullinan et al. | 430/393 |

*Primary Examiner*—Charles L. Bowers, Jr.
*Assistant Examiner*—Thomas R. Neville
*Attorney, Agent, or Firm*—Alfred P. Lorenzo

[57] ABSTRACT

A process for stabilizing the magenta dye image in a photographic color element comprises the step of treating the element after the step of color developing and prior to the step of bleaching or bleach-fixing with an aqueous solution that has a pH in the range of 7 to 10 and contains an effective amount of an alkali metal formaldehyde bisulfite.

7 Claims, No Drawings

PROCESS FOR STABILIZING PHOTOGRAPHIC ELEMENTS

CROSS-REFERENCE TO RELATED APPLICATIONS

U.S. patent application Ser. No. 286,005, "Bleach-Accelerating Compositions Containing A Dye-Stabilizing Agent And Use Thereof In Photographic Color Processing", Ann M. Cullinan and Paul A. Schwartz, filed Dec. 19, 1988 and issued May 1, 1990, as U.S. Pat. No. 4,921,779, describes the use of formaldehyde precursors as dye-stabilizing agents in conditioning baths containing bleach-accelerating agents.

U.S. patent application Ser. No. 286,111, "Bleaching Compositions Containing A Dye-Stabilizing Agent And Use Thereof In Photographic Color Processing", Ann M. Cullinan and Paul A. Schwartz, filed Dec. 19, 1988 and issued Oct. 2, 1990, as U.S. Pat. No. 4,960,682, describes the use of formaldehyde precursors as dye-stabilizing agents in photographic bleaching solutions.

FIELD OF THE INVENTION

This invention relates in general to color photography and in particular to methods and compositions for use in the processing of color photographic elements. More specifically, this invention relates to an improved processing method which is useful in photographic color processing to provide enhanced magenta dye stability.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue-sensitive, another green-sensitive and another red-sensitive. Although these layers can be arranged on a support in any order, they are most commonly arranged with the support coated in succession with the red-sensitive layer, the green-sensitive layer and the blue-sensitive layer (advantageously with a bleachable blue-light-absorbing filter layer between the blue-sensitive layer and the green-sensitive layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light-sensitive layers. Color photographic elements containing dye images usually utilize a phenolic or naphtholic coupler that forms a cyan dye in the red-sensitive emulsion layer, a pyrazolone or cyanoacetyl derivative coupler that forms a magenta dye in the green-sensitive emulsion layer and an acetylamide coupler that forms a yellow dye in the blue-sensitive emulsion layer. Diffusible couplers are used in color developer solutions. Non-diffusing couplers are incorporated in photographic emulsion layers. When the dye image formed is to be used in situ, couplers are selected which form non-diffusing dyes. For image transfer color processes, couplers are used which will produce diffisible dyes capable of being mordanted or fixed in the receiving sheet.

In the production of color photographic images, it is necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing thiourea or a substituted thiourea as described in Kellog, U.S. Pat. No. 2,487,446 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; a formaldehyde bisulfite as described in Seary et al, U.S. Pat. No. 2,647,057 issued July 28, 1953; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; carbohydrazides as described in Larson, U.S. Pat. No. 3,201,244, issued Aug. 17, 1965; amino acids as described in Jeffreys, U.S. Pat. No. 3,291,606 issued Dec. 13, 1966; mixtures of an aldehyde and an alkoxy-substituted polyoxyethylene compound as described in Seemann et al, U.S. Pat. No. 3,369,896 issued Feb. 20, 1968; compounds comprising a tri(hydroxymethyl)methyl group as describes in Jeffreys et al, U.S. Pat. No. 3,473,929 issued Oct. 21, 1969; and addition complexes of an alkali metal bisulfite and an aldehyde as described in Mowrey, U.S. Pat. No. 3,676,136 issued July 11, 1972. The use of more than one active agent in such stabilizing baths is also known. For example, U.S. Pat. No. 3,676,136 to Mowrey describes the use of antioxidants such as glucose, galactose, sorbitol or mannitol in a stabilizing bath in addition to an aldehyde bisulfite addition complex.

Magenta dye stability is a particularly serious problem in color photography, as the magenta dye image tends to fade much more rapidly than either the cyan dye image or the yellow dye image. The darkkeeping stability of magenta image dyes derived from pyrazolone couplers is adversely affected by the presence of the coupler itself. This is particularly evident in the toe and midscale regions of the green sensitometric curve. In these areas, there is a substantial amount of the unreacted coupler. This unreacted coupler undergoes complex chemical reactions with the magenta dye.

For many years, formaldehyde has been commonly used as a stabilizing agent in photographic color processing to provide enhanced magenta dye stability. The photographic element is treated with a final bath containing formaldehyde, and the magenta-dye-forming coupler and the formaldehyde react to form a compound that does not cause dye fade. Under normal processing conditions, this reaction takes place in the drying oven. However, while formaldehyde is a very effective stabilizing agent for this purpose, its use is highly disadvantageous from an ecological standpoint because of the well known ecological concerns relating to formaldehyde.

It has been proposed heretofore to use an alkali metal formaldehyde bisulfite, such as sodium formaldehyde bisulfite, in the final step of processing to provide enhanced dye stability. (See, for example, U.S. Pat. Nos. 2,647,057 and 3,676,136). Such compounds are not subject to the same ecological concerns as formaldehyde, and therefore their use in photographic processing would be highly advantageous. However, use of an aqueous solution of an alkali metal formaldehyde bisulfite as the final processing bath is disadvantageous because it tends to cause spotting of the photographic element and because it requires that drying of the photographic element be carried out at elevated temperatures in order to provide effective enhancement of magenta image dye stability.

It is toward the objective of providing an improved process which renders feasible the use of alkali metal formaldehyde bisulfites on a commercial basis that the present invention is directed.

SUMMARY OF THE INVENTION

In accordance with this invention, it has been unexpectedly found that excellent enhancement of magenta image dye stability can be achieved by treating a photographic element after the step of color developing and prior to the step of bleaching or bleach-fixing with an aqueous solution that has a pH in the range of 7 to 10 and contains an effective amount of an alkali metal formaldehyde bisulfite. By use of this method, problems of spotting are avoided and elevated drying temperatures are not required to achieve effective dye-stabilizing activity.

DESCRIPTION OF THE PREFERRED EMBODIMENTS

The stabilizing composition of this invention can be used to provide improved dye stability with any of a wide variety of color photographic elements. Thus, for example, the stabilizing composition can be advantageously employed in the processing of photographic elements designed for reversal color processing or in the processing of negative color elements or color print materials. The stabilizing composition can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

Typical examples of photographic elements with which the stabilizing composition of this invention can be advantageously utilized are those described in Research Disclosure, Item 17643, Vol. 176, December, 1978, published by Industrial Opportunities Ltd., Homewell, Havant Hampshire, P09 1EF, United Kingdom.

The photographic elements which are advantageously treated in the improved process of this invention are elements comprising a support having thereon at least one, and typically three or more, hydrophilic colloid layers containing a dye image. Any of a wide variety of colloids can be utilized in the production of such elements. Illustrative examples of such colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like.

Processes employing the stabilizing composition of this invention can vary widely in regard to the particular processing steps utilized. For example, the process can comprise, in order, the steps of color developing, treatment with the stabilizing bath and bleach fixing or it can comprise, in order, the steps of color developing treatment with the stabilizing bath, bleaching and fixing. Alternatively, it can be a color reversal process in which the processing baths utilized are, in order, a first developer, a reversal bath, a color developer, the stabilizing bath, a bleach and a fix. In a particularly preferred embodiment of the invention, the processing baths utilized are, in order, a first developer, a reversal bath, a color developer, the stabilizer bath and a bleach-fix bath.

Photographic color processing is typically carried out using a color developing solution which contains a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediaminemonohydrochloride,
4-N,N-diethyl-2-methylphenylenediamine monohydrochloride,
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride,
and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones.

It is particularly well known to use a ferric complex of an aminopolycarboxylic acid as a bleaching agent in photographic color processing. Such complexes are used in both bleaching compositions and bleach-fixing compositions. A very large number of different compounds of the aminopolycarboxylic acid class are disclosed in the prior art as being useful photographic bleaching agents. However, the usual commercial practice is to use an ammonium or alkali metal salt of a ferric complex of ethylenediaminetetraacetic acid (EDTA) or of a ferric complex of propylenediaminetetraacetic acid (PDTA).

Among the numerous patents describing the use of ferric complexes of aminopolycarboxylic acids in bleaching and/or bleach-fixing baths are U.S. Pat. Nos. 3,241,966, 3,615,508 and 3,767,401 and British patent Nos. 1,365,453, 1,392,163, and 1,394,357.

The fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

In reversal color processing, the first developer reduces the exposed silver halide to metallic silver; the reversal bath nucleates the silver halide that remains after first development, the color developer converts the nucleated silver halide to metallic silver and forms the dye images, the bleach converts all metallic silver to silver halide, and the fix converts the silver halide into soluble silver complexes that are washed from the element. In some instances, the bleach and fix are advantageously combined into a bleach-fix bath. In some instances, use of a reversal bath is rendered unnecessary by using a re-exposure step or by incorporating a fogging agent in the color developing bath.

In the aforesaid color reversal process, the first developer contains a black-and-white developing agent or a mixture of such developing agents. Useful developing agents include dihydroxybenzene developing agents such as hydroquinone, 3-pyrazolidone developing agents such as 1-phenyl-3-pyrazolidone, and aminophenol developing agents such as paraaminophenol. In addition to the developing agent, the first developer typically contains other agents such as preservatives, sequestering agents, restrainers, antifoggants, buffers and silver halide solvents. The reversal bath contains a nucleating agent, usually a boron compound or a chelated stannous salt that functions as a reducing agent, as well as antioxidants, buffers, fungicides and sequestering agents.

In the improved method of this invention, the photographic element is treated between the color developing step and the bleaching or bleach-fixing step with an aqueous solution which has a pH in the range of 7 to 10 and contains an alkali metal formaldehyde bisulfite. Useful alkali metal formaldehyde bisulfites include lithium formaldehyde bisulfite, potassium formaldehyde bisulfite and sodium formaldehyde bisulfite. The element is treated for a sufficient time to enhance the stability of the magenta dye image, with useful times typically being in the range of from 1 to 5 minutes. The concentration of alkali metal formaldehyde bisulfite in the solution is not narrowly critical, and can range from about 10 to about 80 grams per liter. Also the temperature of treatment can vary widely as desired, with good results usually being obtained in a range of from about 20° C. to about 45° C. Use of a solution with a pH of below 7 is disadvantageous, since it tends to result in the liberation of free formaldehyde into the atmosphere and it is an objective of the invention to avoid such liberation as much as possible. Use of a solution with a pH of above 10 is also disadvantageous, since carry over of highly alkaline solutions into the bleach or bleach-fix solution which follows the stabilizing bath adversely affects its performance. If desired, an alkaline agent can be included in the solution of alkali metal formaldehyde bisulfite in order to control its pH. Useful alkaline agents for this purpose include hydroxides such as sodium hydroxide or potassium hydroxide, borates such as sodium metaborate, phosphates such as trisodium phosphate, and carbonates such as sodium carbonate or potassium carbonate.

The invention is further illustrated by the following examples of its practice.

EXAMPLES 1-24

In the following examples, the film that was processed was a conventional color reversal photographic film. This film contained a 1-aryl-5-pyrazolone magenta coupler of the formula:

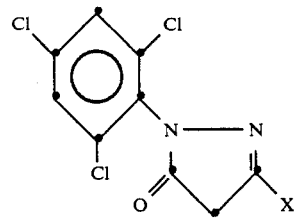

where X represents:

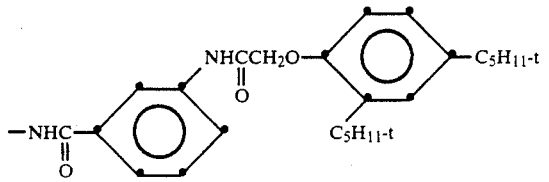

The 1-aryl-5-pyrazolone magenta couplers are believed to react with formaldehyde in accordance with the following equation:

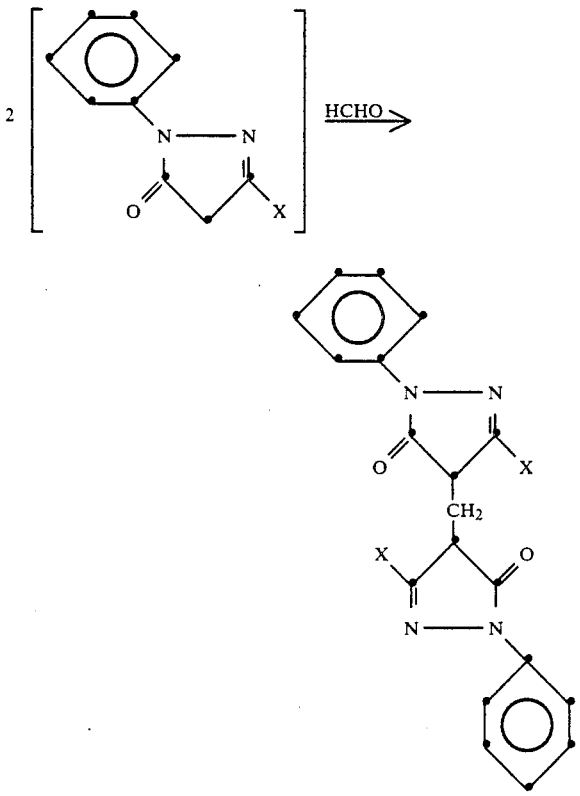

Reaction of the magenta coupler with formaldehyde prevents it from reacting with the magenta dye formed by color development.

The color reversal film was processed in Control Test 1 using a conventional color reversal process employing the following steps and processing times at the indicated temperatures:

| | 21° C. | 42° C. |
|---|---|---|
| First Developer | 27 min | 4.25 min |
| Wash | 2 min | 2 min |
| Color Developer | 9 min | 5 min |
| Wash | 2 min | 2 min |
| Bleach-Fix | 10 min | 10 min |
| Wash | 4 min | 4 min |
| Stabilizer | 1 min | 1 min |

In Control Test 1, the stabilizer was an aqueous bath containing formaldehyde and a wetting agent. Control Test 2 was carried out in the same manner as Control Test 1 except that water was used as the stabilizer.

In each of Examples 1 to 24, the processing steps and times at the indicated temperatures were as follows:

| | 21° C. | 42° C. |
|---|---|---|
| First Developer | 27 min | 4.25 min |
| Wash | 2 min | 2 min |
| Color Developer | 9 min | 5 min |
| Stabilizer | As indicated | As indicated |
| Bleach-Fix | 10 min | 10 min |
| Wash | 4 min | 4 min |
| Rinse | 1 min | 1 min |

The compositions utilized as the stabilizer in Examples 1 to 24 were aqueous solutions of sodium formaldehyde bisulfite and the pH controlling agent sodium hydroxide. The concentrations of sodium formaldehyde bisulfite and the pH values were as indicated below.

For each of Control Tests 1 and 2 and Examples 1 to 24, measurements were made of the percentage change in green density at the 1.0 density level after three days at 77° C. (referred to as delta green density). The results obtained are reported in the following table.

| Test Number | Concentration of sodium formaldehyde bisulfite (g/liter) | pH | Time (min.) | Temperature (°C.) | Pecentage Change in Green Density |
|---|---|---|---|---|---|
| Control Test 1 | — | | | | −7 |
| Control Test 2 | — | | | | −35 |
| Example 1 | 30 | 7 | 2 | 21 | −9 |
| Example 2 | 60 | 7 | 2 | 21 | −5 |
| Example 3 | 30 | 9 | 2 | 21 | −8 |
| Example 4 | 60 | 9 | 2 | 21 | −5 |
| Example 5 | 30 | 7 | 4 | 21 | −6 |
| Example 6 | 60 | 7 | 4 | 21 | −4 |
| Example 7 | 30 | 9 | 4 | 21 | −4 |
| Example 8 | 60 | 9 | 4 | 21 | −2 |
| Example 9 | 30 | 7 | 2 | 42 | −5 |
| Example 10 | 60 | 7 | 2 | 42 | −3 |

As indicated by the data in the table above, in Control Test 1, the coupler reacted with formaldehyde so that no unreacted coupler remained and the dye stability was good, but there was an undesirably high concentration of formaldehyde in the vicinity of the processing equipment. When water was used in Control Test 2 in place of the stabilizing bath, the result was freedom from objectionable formaldehyde vapor in the atmosphere, but inadequate magenta dye stability. In each of examples 1 to 24, the presence of objectionable formaldehyde vapor was avoided, yet improvement in dye stability, as compared with Control Test 2, was achieved by the treatment with a solution of an alkali metal formaldehyde bisulfite subsequent to color development and prior to bleach-fixing.

The invention has been described in detail with particular reference to preferred embodiments thereof, but it will be understood that variations and modifications can be effected within the spirit and scope of the invention.

What is claimed is:

1. In a method of processing an imagewise exposed photographic element in which a magenta image is formed by coupling of oxidized developing agent with magenta-dye-forming coupler, said method comprising the steps of color development, bleaching and fixing or the steps of color development and bleach-fixing; the improvement which comprises treating said element between the steps of color development and bleaching, or between the steps of color development and bleach-fixing, with an aqueous stabilizing bath which has a pH in the range of 7 to 10 and consists essentially of an aqueous solution of an alkali metal formaldehyde bisulfite in an amount effective to enhance the stability of said magenta dye image.

2. The method as claimed in claim 1 wherein said alkali metal formaldehyde bisulfite is sodium formaldehyde bisulfite.

3. The method as claimed in claim 1 wherein the time of treatment in said stabilizing bath is 1 to 5 minutes.

4. The method as claimed in claim 1 wherein the concentration of said alkali metal formaldehyde bisulfite in said stabilizing bath is from about 10 to about 80 grams per liter.

5. The method as claimed in claim 1 wherein color development is carried out with an aqueous alkaline developing solution containing a p-phenylenediamine developing agent and bleaching or bleach-fixing is carried out with a ferric complex of an aminopolycarboxylic acid as the bleaching agent.

6. The method as claimed in claim 1 wherein said magenta-dye-forming coupler is a 1-aryl-5-pyrazolone.

7. In a method of processing an imagewise exposed color reversal photographic element in which a magenta dye image is formed by coupling of oxidized developing agent with magenta-dye-forming coupler, said method comprising the steps of first development, color development, and bleach-fixing, the improvement which comprises treating said element between the steps of color development and bleach-fixing with an aqueous stabilizing bath which has a pH in the range of 7 to 10 and consists essentially of an aqueous solution of an alkali metal formaldehyde bisulfite in an amount effective to enhance the stability of said magenta dye image.

* * * * *